US005517691A

United States Patent [19]

Blake

[11] Patent Number: 5,517,691

[45] Date of Patent: May 21, 1996

[54] PROTECTIVE HELMET

[75] Inventor: Bruce H. Blake, Lexington, Ky.

[73] Assignee: Lion Apparel, Inc., Dayton, Ohio

[21] Appl. No.: 452,382

[22] Filed: May 26, 1995

Related U.S. Application Data

[63] Continuation of Ser. No. 41,555, Apr. 2, 1993, abandoned.

[51] Int. Cl.[6] ..... A42B 3/10

[52] U.S. Cl. ..... 2/5; 2/416; 2/418; 2/414

[58] Field of Search ..... 2/410, 5, 6.6, 411, 2/412, 414, 415, 416, 417, 418, 420, 424, 425

[56] References Cited

U.S. PATENT DOCUMENTS

| | | | |
|---|---|---|---|
| Re. 32,569 | 1/1988 | Aileo et al. . | |
| 908,145 | 12/1908 | Sass . | |
| 1,599,695 | 9/1926 | Wagner . | |
| 1,749,998 | 3/1930 | Collins . | |
| 1,835,883 | 12/1931 | Lewis . | |
| 1,860,690 | 5/1932 | Rateau . | |
| 2,025,772 | 12/1935 | Punton . | |
| 2,306,362 | 12/1942 | Wolff . | |
| 2,421,427 | 6/1947 | Mamlin et al. . | |
| 2,601,149 | 6/1952 | Jamison, Jr. . | |
| 2,710,965 | 6/1955 | Bowers . | |
| 2,738,508 | 3/1956 | Cairns . | |
| 3,087,165 | 4/1963 | Cairns . | |
| 3,100,896 | 8/1963 | Khanbegian . | |
| 3,205,508 | 9/1965 | Cox | 2/410 |
| 3,845,389 | 10/1974 | Phillips et al. . | |
| 3,852,822 | 12/1974 | Watkins et al. . | |
| 3,992,721 | 11/1976 | Morton . | |
| 3,994,023 | 11/1976 | Aileo et al. . | |
| 4,020,507 | 5/1977 | Morton . | |
| 4,133,055 | 1/1979 | Zebuhr . | |
| 4,286,339 | 9/1981 | Coombs . | |
| 4,432,099 | 2/1984 | Grick et al. . | |
| 4,558,470 | 12/1985 | Mitchell et al. . | |
| 4,619,003 | 10/1986 | Asbury . | |
| 4,656,667 | 4/1987 | Blake | 2/5 |
| 4,766,609 | 8/1988 | Lane . | |
| 4,829,599 | 5/1989 | Giorgio et al. . | |
| 4,912,778 | 4/1990 | Daniels . | |
| 4,932,076 | 6/1990 | Giorgio et al. | 2/5 |
| 4,970,729 | 11/1990 | Shimazaki . | |
| 4,975,980 | 12/1990 | Ersteniuk . | |
| 4,999,846 | 3/1991 | Ball et al. . | |
| 5,014,365 | 5/1991 | Schulz . | |
| 5,018,220 | 5/1991 | Lane et al. . | |
| 5,044,016 | 9/1991 | Coombs . | |
| 5,056,162 | 10/1991 | Tirums . | |
| 5,079,780 | 1/1992 | Coombs et al. . | |
| 5,083,320 | 1/1992 | Halstead | 2/413 |
| 5,113,534 | 5/1992 | Lane et al. . | |
| 5,121,508 | 6/1992 | Grilliot et al. . | |
| 5,150,479 | 9/1992 | Oleson | 2/414 |

FOREIGN PATENT DOCUMENTS

| | | |
|---|---|---|
| 2539277 | 7/1984 | France . |
| WO84/01697 | 5/1984 | WIPO . |

*Primary Examiner*—Michael A. Neas

*Attorney, Agent, or Firm*—Killworth, Gottman, Hagan & Schaeff

[57] ABSTRACT

An impact attenuation liner assembly is provided for use in an outer shell of a protective helmet. The liner assembly includes an impact cap formed from a resilient, heat-resistant material, such as expanded polypropylene. The impact cap defines a head receiving cavity and includes a plurality of passageways extending therethrough. A suspension system is also provided and comprises a plurality of straps disposed within the head receiving cavity. The straps have end portions, each of which extends through a different one of the passageways in the impact cap. Ribs are located on the exterior surface of the impact cap for securing the end portions to the impact cap. Tape extending about a peripheral portion of the exterior surface of the cap is also provided for securing the ribs in recesses formed in the exterior surface of the cap.

17 Claims, 4 Drawing Sheets

PROTECTIVE HELMET

CROSS-REFERENCE TO RELATED APPLICATION

This is a continuation of application Ser. No. 08/041,555, filed Apr. 2, 1993 now abandoned.

BACKGROUND OF THE INVENTION

The present invention relates generally to an impact attenuation liner assembly for a protective helmet, such as a fire helmet, and to a protective helmet including such a liner assembly.

There are known in the prior art fire helmets which include liner systems for absorbing forces such as might be encountered during fire fighting activities. For example, U.S. Pat. No. 4,286,339 discloses a fireman's helmet having an outer shell, an inner liner and a plastic rim which encases the lower portion of the inner liner. The inner liner is molded from a non-resilient foam material, such as polyurethane. Associated with the inner liner is a cradle of radially disposed web straps. The straps are joined together at the central apex of the cradle and extend downwardly to the annular rim. Each strap passes beneath the annular rim and proceeds upwardly along the outer surface of the annular rim, wraps about a tube inset in a groove in the outer surface of the inner liner, and then proceeds under the annular rim to approach the apex as a free end. The free ends of the straps are secured to a draw string which is knotted to allow adjustment of the size of the cradle.

Apex impact forces occurring on the referenced helmet can cause the web straps to stretch, flatten the tube about which the straps are wrapped, and deform the compressible, non-resilient inner liner. Deformation of the non-resilient foam liner will likely result in permanent damage to the liner, which may prevent further use of the liner. Furthermore, the polyurethane liner, if exposed to high temperatures, will expand. Such expansion may cause the liner to crack and may also cause the inner liner to push itself out of the outer shell. Thus, this liner is essentially a "single use" liner since it cannot be reused if expansion of the liner occurs during use in a high temperature environment, or an impact force of sufficient magnitude impinges on the helmet causing permanent deformation of the foam liner. A further disadvantage of the liner is the plastic rim, which adds weight to and increases the cost of the helmet.

Accordingly, there is a need for an improved impact attenuation liner assembly for a protective helmet wherein the liner assembly includes an impact cap formed from a resilient, heat-resistant material.

SUMMARY OF THE INVENTION

This need is met by the present invention wherein an impact attenuation liner assembly is provided which is adapted for use in an outer shell of a protective helmet, such as a fire helmet. The liner assembly includes an impact cap formed from a resilient, heat-resistant material, such as expanded polypropylene. Provided within the impact cap is a suspension system having a plurality of straps adapted to receive a wearer's head. Ribs connect the straps directly to the impact cap. Thus, when an apex impact force, within design limits, is applied to the outer shell, the straps stretch and the impact cap deforms at rib locations to cushion and absorb the applied force. Since the impact cap is formed from a resilient material, after deformation, it returns to its previous shape. The impact cap can also withstand high temperature environments since the material from which it is formed is heat resistant.

In accordance with a first aspect of the present invention, an impact attenuation liner assembly is provided which is adapted to be received within a recess of an outer shell of a protective helmet. The liner assembly includes an impact cap having a plurality of passageways extending therethrough and defining an inner head receiving cavity. A suspension system is further provided and comprises a plurality of straps disposed within the head receiving cavity. The straps have end portions, each of which extends through a different one of the passageways in the impact cap. Means located on the exterior surface of the impact cap is also provided for securing the end portions to the impact cap.

The impact cap is preferably formed from a resilient, heat-resistant polymeric material, such as expanded polypropylene. The securing means comprises a plurality of ribs positioned about the exterior surface of the impact cap which engage with the end portions of the straps. Each of the ribs is disposed in one of a plurality of outwardly opening recesses formed in the exterior surface of the impact cap. The securing means further includes tape extending about a lower peripheral portion of the exterior surface of the impact cap for securing the ribs in the recesses formed in the exterior surface of the impact cap. The ribs are arcuately shaped to conform to the outer surface of the impact cap. Each of the end portions of the straps is formed as a mounting loop for receiving one of the ribs.

In accordance with a second aspect of the present invention, a protective helmet is provided including an outer shell with a recess; a resilient polymeric impact cap adapted to be received within the recess of the outer shell and defining a head receiving cavity; a suspension system comprising a plurality of straps disposed within the head receiving cavity and adapted to engage a wearer's head; and, means located on the exterior surface of the impact cap and being associated with the end portions of the straps for securing the end portions to the impact cap.

The impact cap includes a plurality of passageways extending therethrough which are each spaced a predetermined distance from the lower edge of the cap. The suspension system comprises a plurality of straps disposed within the cavity for engaging a wearer's head. The straps have end portions, each of which extends through a different one of the passageways in the impact cap. More specifically, each of the straps extends between two substantially diametrically opposed ones of the passageways.

The impact cap is formed from a resilient, heat-resistant polymeric material, such as expanded polypropylene. The means for securing the end portions of the straps to the impact cap includes ribs as discussed above with respect to the first aspect of the present invention.

Accordingly, it is an object of the present invention to provide an impact attenuation system having an impact cap formed from a resilient, heat-resistant polymeric material and which is adapted to be received within a recess of an outer shell of a protective helmet. It is a further object of the present invention to provide an impact attenuation system for use in a protective helmet wherein the attenuation system includes a lightweight impact cap and an improved suspension system. It is an additional object of the present invention to provide a protective helmet having an attenuation system that includes an impact cap formed from a resilient, heat-resistant polymeric material. These and other objects and advantages will be apparent from the following description, the accompanying drawings and the appended claims.

DETAILED DESCRIPTION OF THE INVENTION

Figure 1:
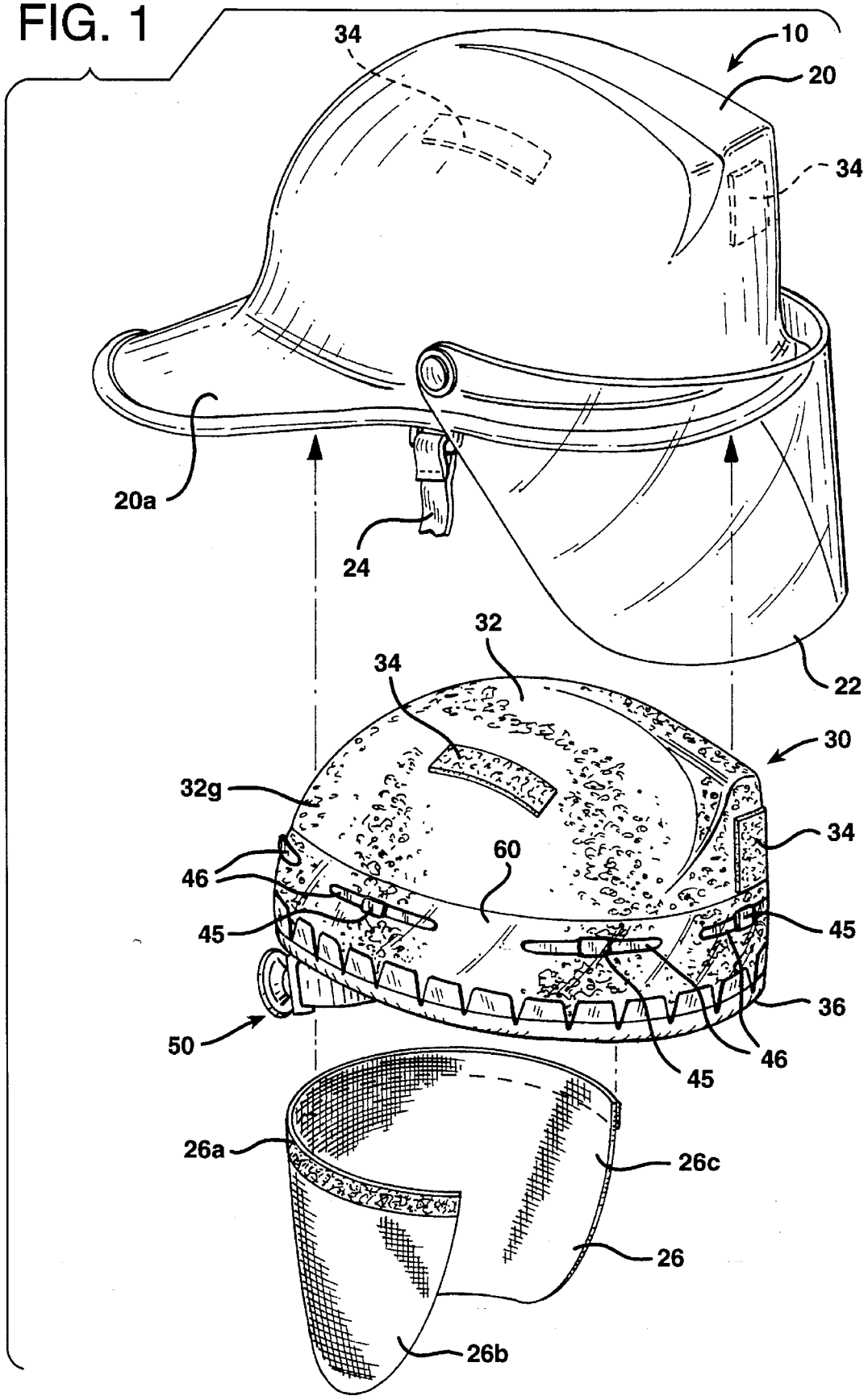
FIG. 1 an exploded view of a fire helmet including an outer shell and an impact attenuation system constructed in accordance with the present invention.

Referring now to the drawings, FIG. 1 is an exploded view of a fire helmet 10 constructed in accordance with the present invention. The helmet 10 comprises an outer shell 20 and an impact attenuation system 30. The attenuation system 30 includes an impact cap 32 which fits within a conforming inner recess of the outer shell 20 and is removably attached to the latter by patches 34 of loop-pile fastening material, such as that commonly sold under the trademark Velcro. The impact attenuation system 30 further includes a suspension system 40 having a plurality of flexible straps 42–44, and an adjustable headband assembly 50, see FIGS. 2 and 4.

The impact cap 32 is formed from joined expanded polypropylene beads. The beads have a preferred density of 5.0 lbs/ft$^3$, and are commercially available from Arco Chemical Company under the trademark ARPRO Expanded Polypropylene Beads. The beads are joined together within an inner cavity of a mold (not shown) under approximately 45.0 psi of steam pressure.

The impact cap 32 includes a plurality of passageways **32*a*–32*f* extending therethrough. Each flexible strap 42–44 includes two end portions formed as mounting loops 45 which extend through two substantially diametrically opposed ones of the passageways 32*a*–32*f*. Thus, as best shown in FIG. 4, the flexible strap 42 extends between and its end portions pass through passageways 32*a* and 32*d*, the flexible strap 43 extends between and its end portions pass through passageways 32*b* and 32*e*, and the flexible strap 44 extends between and its end portions pass through passageways 32*c* and 32*f***.

Figure 3:
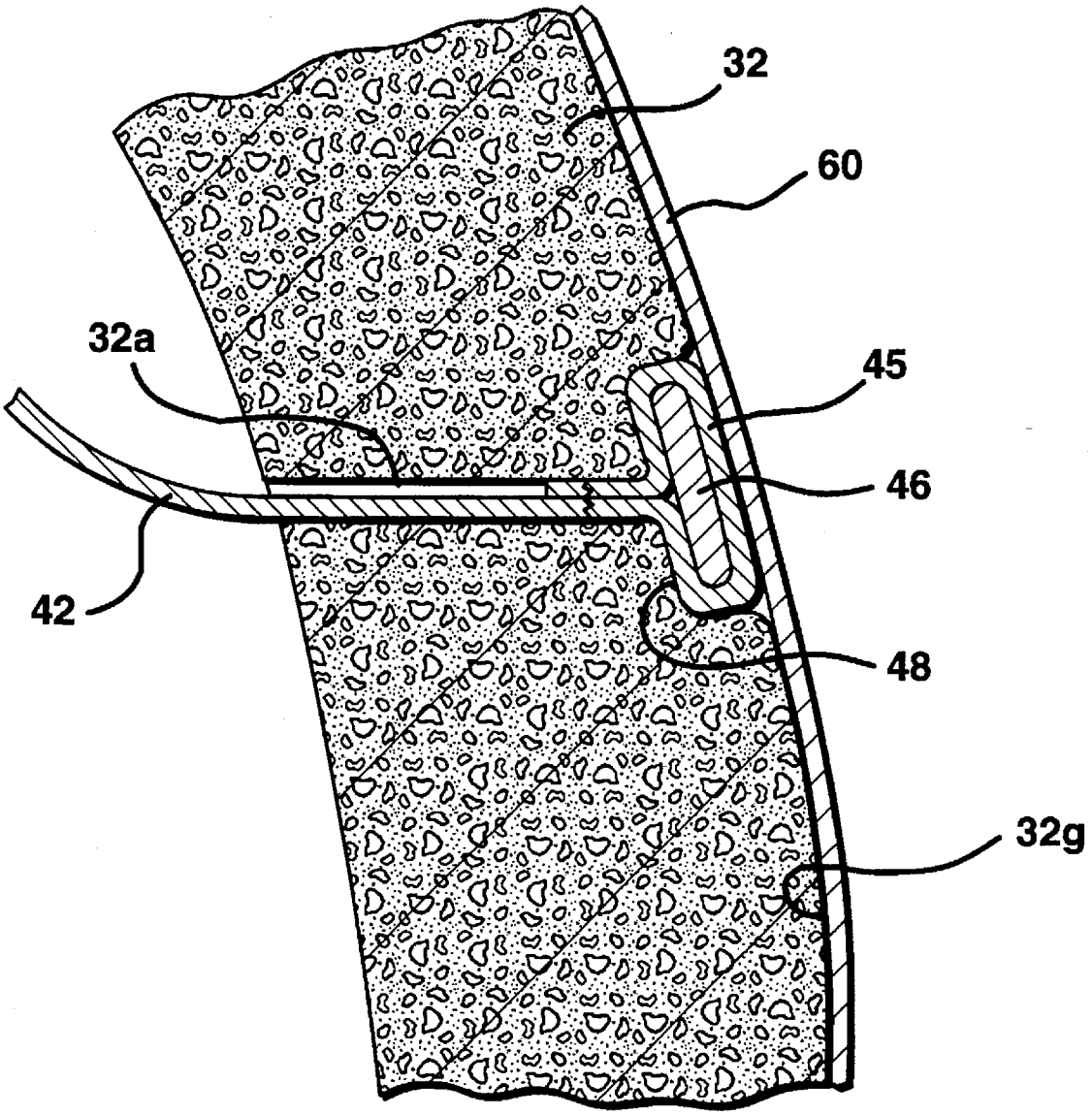
FIG. 3 is an enlarged cross-sectional view showing an end portion of a web strap secured to the impact cap by a rib; and, FIG. 4 is a view looking down into the impact cap of the attenuation system shown in FIG. 1.

Each mounting loop 45, after passing through its corresponding passageway, receives an arcuately shaped mounting rib 46. The ribs 46 are each seated in one of a plurality of outwardly opening recesses 48 formed in the exterior surface **32*g* of the impact cap 32, see FIG. 3. By engaging with the exterior surface 32*g* of the impact cap 32, the ribs 46 serve to secure the flexible straps 42–44 to the cap 32. Adhesive tape 60 extends about a lower peripheral portion of the exterior surface 32*g* of the impact cap 32 for securing the ribs 46 in the recesses 48**.

Figure 4:
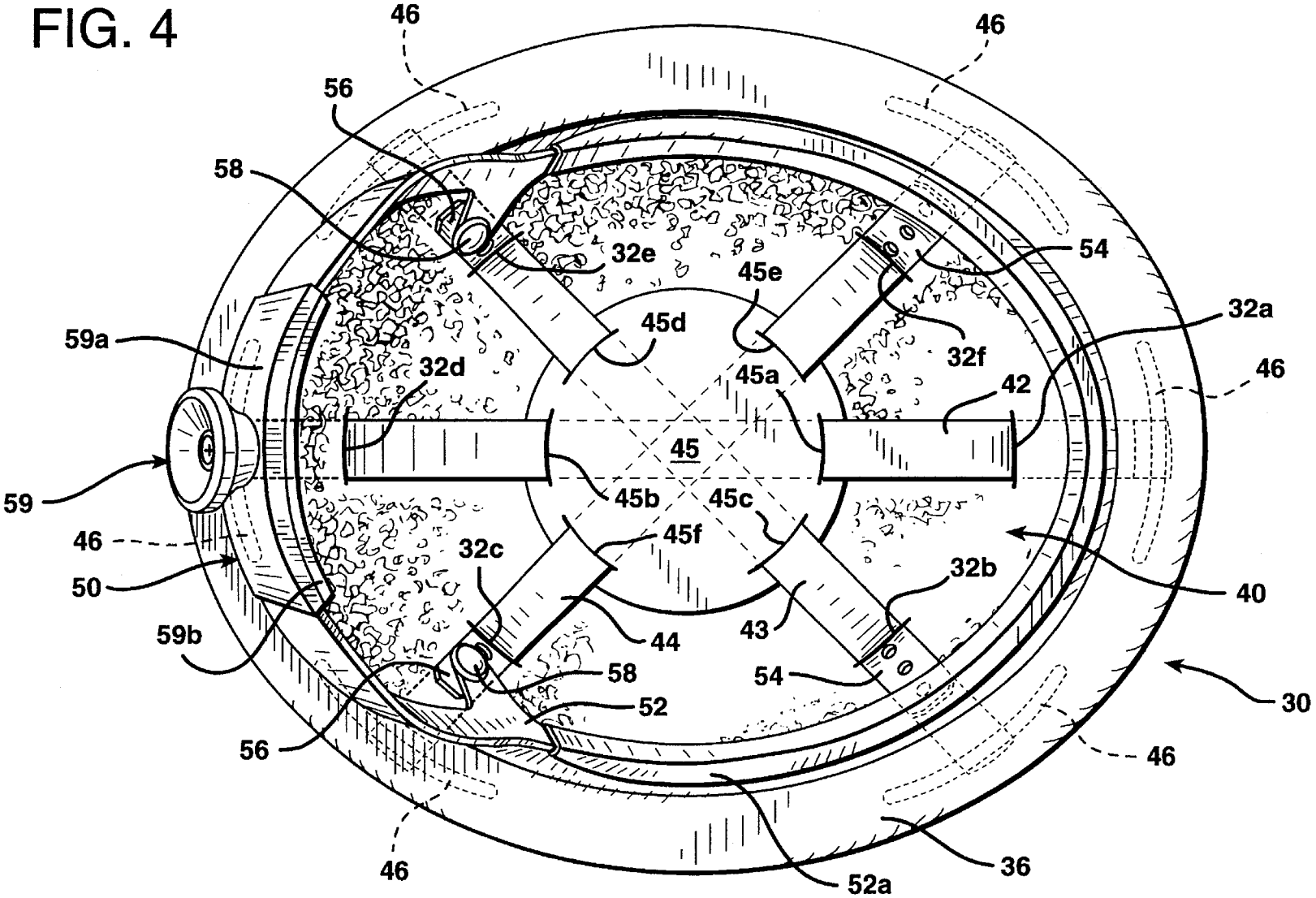

A crown pad 45 is associated with the straps 42–44 and is positioned at the point of intersection of the straps 42–44, see FIG. 4. The pad 45 includes a first pair of diametrically opposed slits **45*a* and 45*b* through which strap 42 passes. It further includes a second pair of diametrically opposed slits 45*c* and 45*d* through which strap 43 passes, and a third pair of diametrically opposed slits 45*e* and 45*f* through which strap 44** passes.

The lower edge **32*h* of the impact cap 32 is encased in an absorbent material 36**, such as that sold by E. I. du Pont de Nemours and Co. under the trademark Cool-Max.

Figure 2:
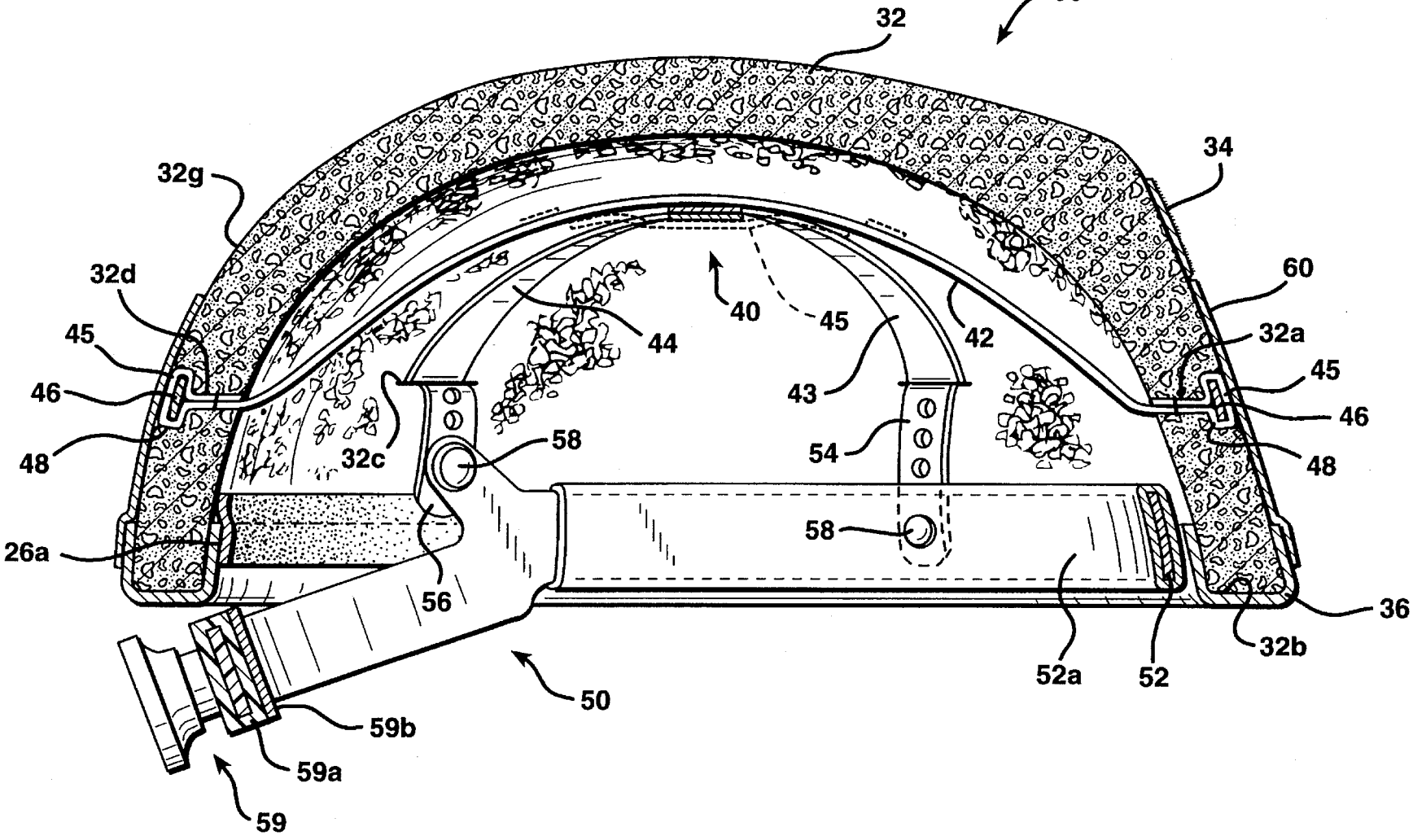
FIG. 2 is a side view, in cross section, showing the impact attenuation system in FIG. 1.

As best shown in FIGS. 2 and 4, the adjustable headband assembly 50 includes an adjustable oval-shaped band 52 which is adapted to encircle the head of a wearer in the usual and well known manner. The band 52 includes a padded brow pad **52*a* which is constructed from an absorbent material, such as the material sold by E. I. du Pont de Nemours and Co. under the trademark Cool-Max. The brow pad 52*a* is secured to the band 52 by Velcro loop-pile fastening material (not shown). Also provided are forward and rearward attachment elements 54 and 56 which are stitched or otherwise fixedly secured to the mounting loops 45 of straps 43 and 44. The band 52 is removably secured to attachment elements 54 and 56 by conventional snap fasteners 58. Adjustment of the diameter of the band 52 is accomplished by means of a well-known ratchet assembly 59, or by other suitable adjusting means. Portion 59*a* of the ratchet assembly 59 is also lined with an absorbent material 59*b*, which may comprise the same material used to construct the brow pad 52*a***.

The outer shell 20 is provided with a brim **20*a* which is wider at the back than at the front to shield the back of the wearer's neck. A transparent visor 22 is provided to be lowered to provide eye protection. The visor 22 is molded from any suitable transparent thermoplastic resin such as polyarylate, which material is commercially available from Amoco Performance Products, Inc. under the trademark Ardel. The visor 22 is molded so as to have the curved shape shown in FIG. 1. A chin strap 24** is provided to ensure that the helmet stays securely in place during use.

A two-layer protective cloth 26, which provides heat protection for the neck and ears of the wearer, is secured to the inner surface of the impact cap 32 by Velcro loop-pile fastening material **26*a*. The outer layer 26*b* of the protective cloth 26 is constructed from a 50/50 Kevlar/Nomex blend cloth sheet, which sheet is commercially available under the trademark Advance from Southern Mills, Inc. The inner layer 26*c* is constructed from a 80/20 fire-resistant cotton/Kevlar blend cloth sheet, which sheet is commercially available under the trademark Aracor from Springs Protective Fabrics, a division of Springs Industries, Inc. The outer layer 26*b* is stitched or otherwise secured to inner layer 26*c*, see FIG. 1**.

The outer shell 20 is formed from a continuous strand preformed glass structure which is encapsulated within a resin mixture during a resin transfer molding process.

The glass structure is formed from a mat of continuous glass strands held together by a binder material, which mat of glass strands is commercially available from Vetrotex International under the trademark Unifilo U-750. Superposed over the upper surface of the mat of glass fibers is a sheet of glass veil, which is commercially available from Nicofibers Co. under the trademark Surmat 100SF. The two sheets are heated in an oven and subsequently die-stamped into the shape of a fire helmet. After die-stamping, the underside of the two-layer structure is reinforced at front and rear brim portions by two separate woven sheets of fiberglass material, which material is commercially available from Magnetek Hesgon through supplier Clark-Schwebel Distribution Corp. as glass tape, style No. 520. The two woven sheets of fiberglass may be secured to the two-layer structure by convention spray adhesive. To add additional reinforcement to the helmet, an additional sheet of fiberglass material is adhesively secured to the upper center portion of the inner cavity of the structure. This material is commercially available from Nicofibers Co. under the trademark Conformat N-754.

In accordance with an alternative embodiment of the present invention, the glass structure is constructed by forming the two-layer structure set out above, adding to the entire underside of the two-layer structure a layer of woven Kevlar (trademark), and adding a second layer of glass veil over the entire outer surface of the woven Kevlar layer. Interposed between the Kevlar layer and the second layer of veil at the upper center portion of the inner cavity of the structure is a sheet of fiberglass material, which comprises the material sold by Nicofibers Co. under the trademark Conformat N-754. The Kevlar material is commercially available from E. I. du Pont de Nemours, and the glass veil is the same material used in the two-layer structure discussed above.

After the glass structure has been formed, it is placed within a die cavity of a mold which forms part of a resin transfer molding apparatus (not shown). A resin mixture, which is first heated to a temperature of approximately 100° F., is combined with a catalyst and then injected into the die cavity of the mold. Before the combined resin mixture and catalyst are injected into the die cavity, the mold is preheated to a temperature between 110° F. to 130° F. After curing, the part is removed from the mold.

A preferred resin for use in the present invention is an epoxy-acrylate resin. The resin mixture preferably contains by weight approximately 87.68% of epoxy-acrylate resin, which is commercially available from Ashland Chemical, Inc. under the trademark Hetron® FR 992RT; 0.35% of a resin cure accelerator, such as dimethyl p toluidine, which is commercially available from Esschem Co. under the product code 926 N 0000; 0.44% of an additive to improve material flow, which is sold by Byk-Chemie USA under the trademark Byk®-S 715; 0.13% of an internal mold release additive, which is sold by Axel Plastics Research Laboratories, Inc. under the trademark MOLD WIZ #INT-EQ-6; 8.77% of a color additive, such as diisodecyl phthalate, which is commercially available from American Colors, Inc.; and, 2.63% of a fire retardant additive, which is commercially available from Nyacol Product Inc. under the trademark NYACOL® APE1540. The catalyst is Benzoyl Peroxide, which is commercially available from Elf Atochem North America under the trademark Luperco AFR-400.

Having described the invention in detail and by reference to preferred embodiments thereof, it will be apparent that modifications and variations are possible without departing from the scope of the invention defined in the appended claims.

What is claimed is:

1. An impact attenuation liner assembly adapted to be received within a recess of an outer shell of a fire helmet comprising:

a resilient, heat-resistant polymeric impact cap defining an inner head receiving cavity and having a plurality of passageways extending through said impact cap;

a suspension system comprising a plurality of straps disposed within said head receiving cavity, said straps having end portions each of which extends through and are substantially surrounded by a different one of said passageways in said impact cap, and, securing elements located on the exterior surface of said impact cap and being associated with said end portions of said straps for securing said end portions to said impact cap wherein, upon the application of an apex impact force, said impact cap deforms at the location where said exterior surface of said impact cap is associated with said end portions of said straps, said impact cap returning to its previous shape after deformation.

2. An inner impact attenuation liner assembly as set forth in claim 1, wherein said impact cap is formed from expanded polypropylene.

3. An inner impact attenuation liner assembly as set forth in claim 1, wherein said securing means comprises a plurality of ribs positioned about the exterior surface of said impact cap, each of said ribs being connected to a different one of said end portions of said straps.

4. An inner impact attenuation liner assembly as set forth in claim 3, wherein each of said straps extends between two substantially diametrically opposed ones of said passageways.

5. An inner impact attenuation liner assembly as set forth in claim 3, wherein each of said ribs is disposed in one of a plurality of outwardly opening recesses formed in the exterior surface of said impact cap.

6. An inner impact attenuation liner assembly as set forth in claim 5, wherein said securing means further comprises tape extending about a peripheral portion of the exterior surface of said impact cap for securing said ribs in said recesses formed in the exterior surface of said impact cap.

7. An inner impact attenuation liner assembly as set forth in claim 3, wherein said ribs are generally rectangular and slightly arc-shaped to conform to the outer surface of said impact cap.

8. An inner impact attenuation liner assembly as set forth in claim 3, wherein each of said end portions of said straps is formed as a mounting loop for receiving one of said ribs.

9. A fire helmet comprising:

an outer shell having a recess;

a resilient polymeric impact cap adapted to be received within said recess of said outer shell and defining a head receiving cavity, said impact cap having a plurality of passageways extending therethrough which are each spaced a predetermined distance from the lower edge of said cap;

a suspension system comprising a plurality of straps disposed within said cavity and adapted to engage a wearer's head, said straps having end portions each of which extends through a different one of said passageways in said impact cap; and, securing elements located on the exterior surface of said impact cap and being associated with said end portions of said straps for securing said end portions to said impact cap wherein, upon the application of an apex impact force, said impact cap deforms at the location where said exterior surface of said impact cap is associated with said end portions of said straps, said impact cap returning to its previous shape after deformation.

10. A protective helmet as set forth in claim 9, wherein said impact cap is formed from a resilient, heat-resistant polymeric material.

11. A protective helmet as set forth in claim 9, wherein said impact cap is formed from expanded polypropylene.

12. A protective helmet as set forth in claim 9, wherein said securing means comprises a plurality of ribs positioned about the exterior surface of said impact cap, each of said ribs being connected to a different one of said end portions of said straps such that an apex impact loading force applied to said outer shell is absorbed by said straps and said impact cap.

13. A protective helmet as set forth in claim 12, wherein said suspension system includes three straps which are connected at their end portions to six of said ribs.

14. A protective helmet as set forth in claim 12, wherein each of said ribs is disposed in one of a plurality of outwardly opening recesses formed in the exterior surface of said impact cap.

15. A protective helmet as set forth in claim 12, wherein said securing means further comprises tape extending about a peripheral portion of said exterior surface of said impact cap for securing said ribs in said recesses formed in the exterior surface of said impact cap.

16. A protective helmet as set forth in claim 12, wherein said ribs are arcuately shaped to conform to the outer surface of said impact cap.

17. A protective helmet as set forth in claim 12, wherein each of said end portions of said straps is formed as a mounting loop for receiving one of said ribs.

* * * * *